United States Patent [19]

Rothman

[11] Patent Number: 4,811,937

[45] **Date of Patent: * Mar. 14, 1989**

[54] PORTABLE SURGICAL DRAINAGE PLATFORM

[76] Inventor: Michael L. Rothman, 440 St. Michaels Dr., Santa Fe, N. Mex. 87501

[ * ] Notice: The portion of the term of this patent subsequent to Dec. 22, 2004 has been disclaimed.

[21] Appl. No.: 71,708

[22] Filed: Jul. 9, 1987

Related U.S. Application Data

[63] Continuation-in-part of Ser. No. 924,447, Oct. 29, 1986, Pat. No. 4,718,653, which is a continuation of Ser. No. 792,544, Oct. 29, 1985, Pat. No. 4,635,913.

[51] Int. Cl.[4] ..... A61G 13/00

[52] U.S. Cl. ..... 269/327

[58] Field of Search ..... 269/327, 328, 15, 325, 269/74, 76; 312/229; 211/126, 127, 41; 220/1 C, 8, 9 B, 22.1; 128/303 R; 248/354.1

[56] References Cited

U.S. PATENT DOCUMENTS

| | | | |
|---|---|---|---|
| D. 168,945 | 3/1953 | Liskey, Jr. . | |
| 1,796,493 | 3/1931 | Thompson . | |
| 1,976,100 | 10/1934 | Spriggs et al. . | |
| 2,794,694 | 6/1957 | Fullwood et al. . | |
| 2,851,311 | 9/1958 | Gibbs . | |
| 4,243,214 | 1/1981 | LaRooka . | |
| 4,635,913 | 1/1987 | Rothman . | |
| 4,718,653 | 1/1988 | Rothman | 269/327 |

FOREIGN PATENT DOCUMENTS

| | | | |
|---|---|---|---|
| 2042899 | 8/1979 | Fed. Rep. of Germany | 269/327 |

*Primary Examiner*—Robert C. Watson

*Attorney, Agent, or Firm*—Kelly, Bauersfeld & Lowry

[57] ABSTRACT

A drainage platform for collecting fluids discarded during surgical operations provides a comfortable non-slip surface upon which several medical personnel may stand during an operation. The portable surgical drainage platform includes two outer support trays which are attached by overlapping hinges to a central support tray to form a fluid collection basin. A drain suction manifold is connected to the collection basis to permit single source suction of fluid from all of the support trays. Stationary rollers are fixed to the central support tray and extend downwardly for constant engagement with a ground surface. A selectively extendable and retractable roller mechanism is situated below each outer support tray, which is capable of supporting the overlying support tray to facilitate rolling movement of the platform. The roller mechanisms are alternatively capable of lowering the outer support trays to place them on the ground surface and immobilize the platform. Further, for the convenience of the surgeon, fully adjustable instrument trays and stands are provided.

43 Claims, 7 Drawing Sheets

34
220
218
184
90
117
62
144
32
42
113
9
46
21
48
136
50
54
80
70
94
246
200
168
166
17
214
212
40
142
15
154
2
36
38
16
44
182
198
188
102
100
30
14

FIG. 2
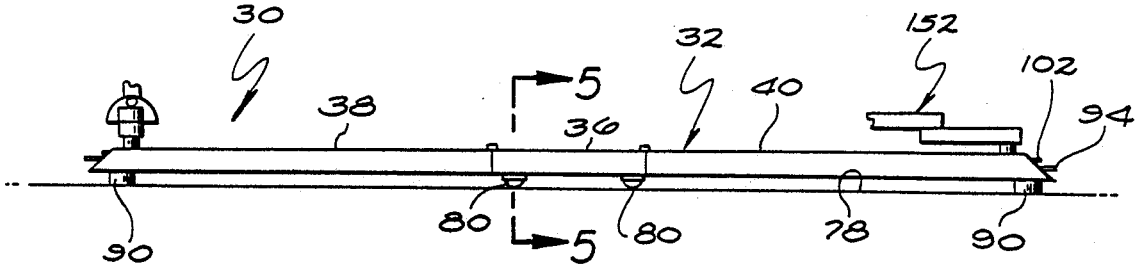
FIG. 3
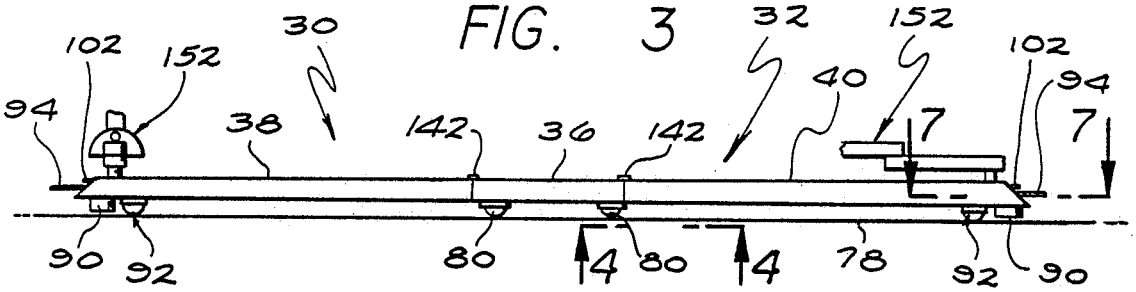
FIG. 4
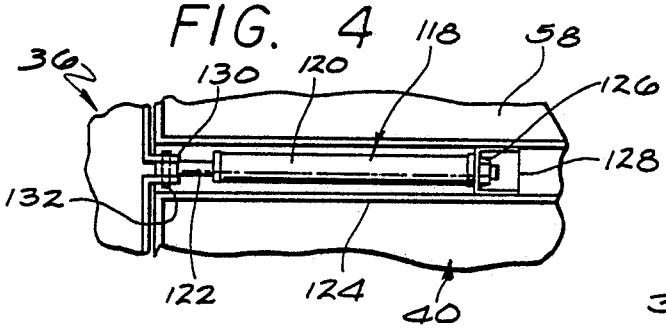
FIG. 5
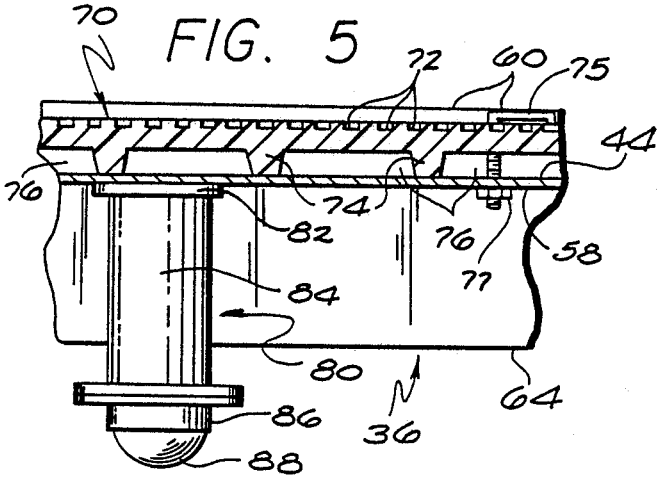
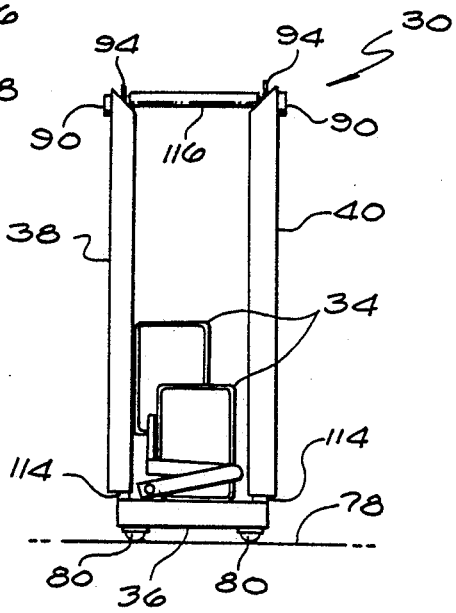
FIG. 6

8
104
110
94
102
108
106
100
44
96
92
62
98
117
40
58
112
36
60
142
12
11
138
140
64
134
114

FIG. 12
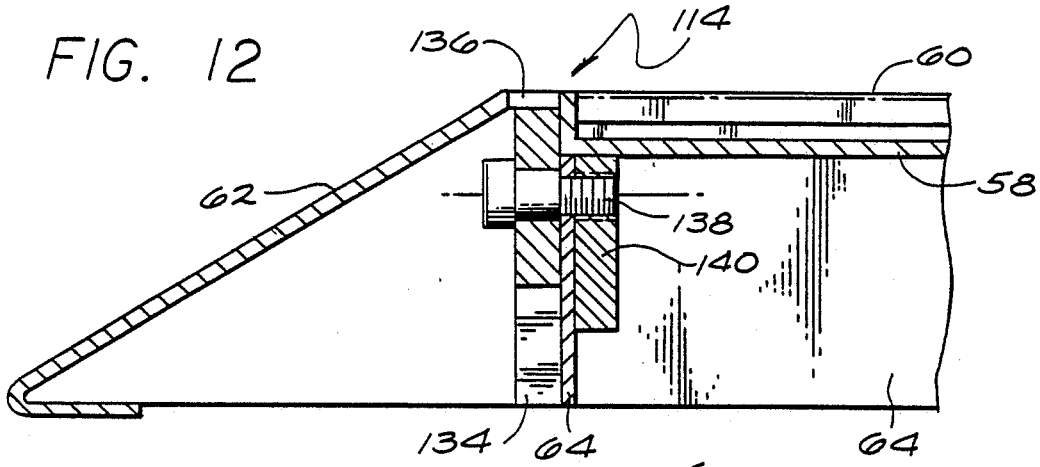
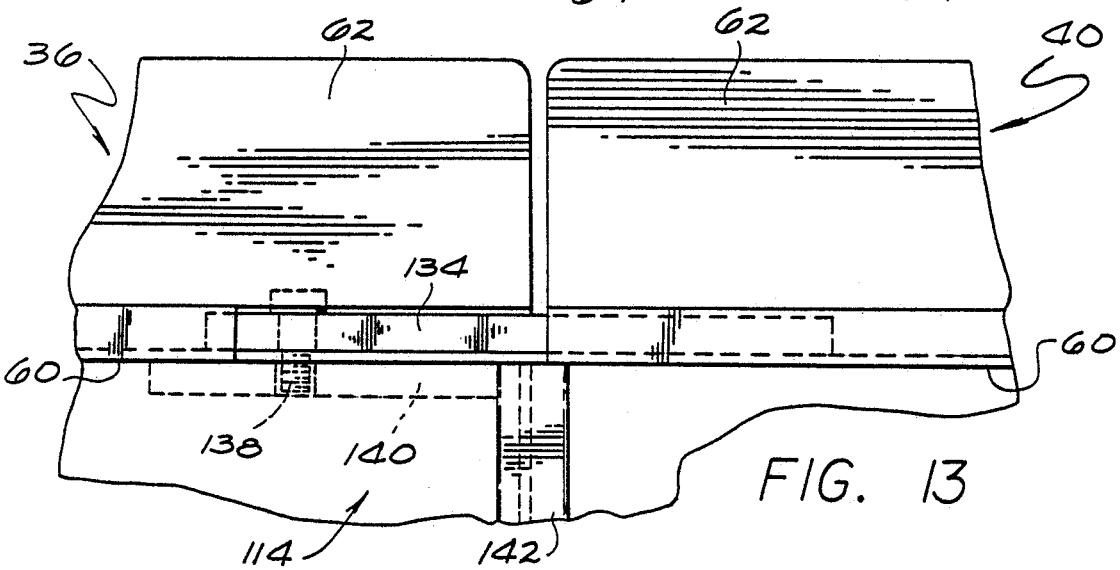
FIG. 13
FIG. 14
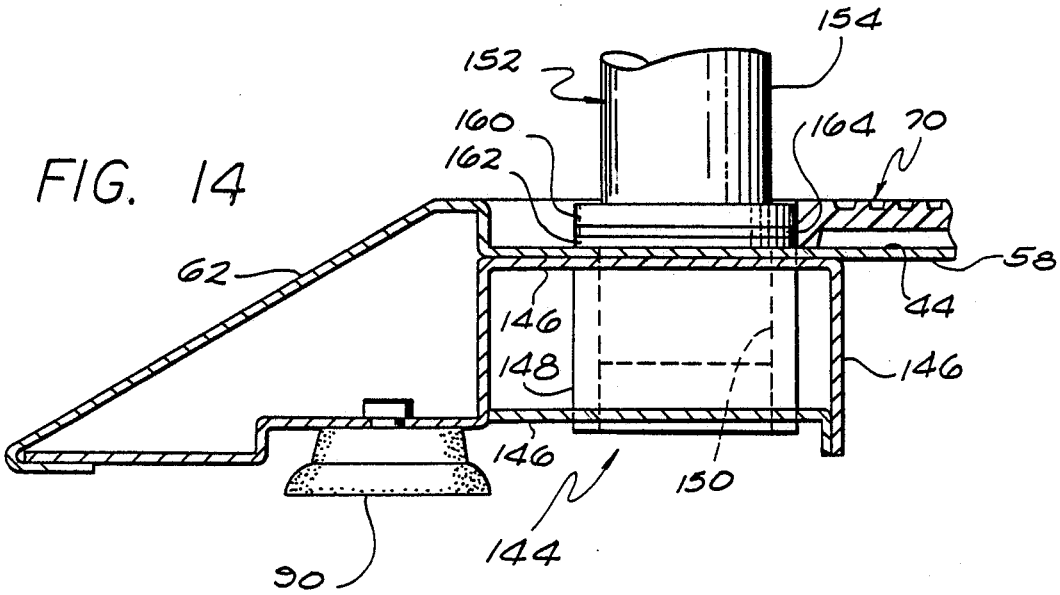

PORTABLE SURGICAL DRAINAGE PLATFORM

RELATED APPLICATIONS

This is a continuation-in-part application of U.S. patent application Ser. No. 06/924,447, filed Oct. 29, 1986, now U.S. Pat. No. 4,718,653 which is a continuation of U.S. patent application Ser. No. 06/792,544, filed Oct. 29, 1985, now U.S. Pat. No. 4,635,913.

BACKGROUND OF THE INVENTION

This invention relates generally to devices utilized during surgical operations. More particularly, the present invention relates to devices for collecting fluids discarded during surgical operations which prevent such fluids from pooling on an operating room floor and creating a hazardous condition for operating room personnel.

Many types of surgical operations involve large quantities of fluids. For example, arthroscopic surgery often requires large quantities of saline solution for cleansing and irrigating the injured area. Trauma surgery similarly requires large quantities of saline solution, but in addition large quantities of blood will usually flow from the traumatized area. In the past these fluids have been allowed to fall onto the floor surrounding an operating table, causing the floor to become excessively slippery and posing a hazardous condition for operating room personnel by increasing the risk of falling or slipping. Furthermore, the shoes and feet of operating room personnel become soaked by the fluids, which can be uncomfortable and distracting.

A simple solution for alleviating this hazardous condition is to provide a grating or a rigid platform upon which operating room personnel may stand. This is not satisfactory in many instances, however, and can create additional problems. For example, a grating or rigid platform does not alleviate the hazard posed by the slippery operating room floor unless the entire floor is covered. Such a solution is not satisfactory since an entire floor covered with a grating or rigid platform is prohibitively costly. Furthermore, the provision of a grating or rigid platform does not lessen the task of cleaning the operating room after the surgery is completed, nor is such a grating or rigid platform easily moved, sterilized or stored.

Accordingly, there has been a long existing need in the medical field for a device which collects fluids discarded during surgical operations, which would otherwise be allowed to pool on the operating room floor and create a hazardous condition for operating room personnel. The device must be easily cleaned and sterilized, and portable for movement within and between operating rooms. Furthermore, the device should help prevent the shoes and feet of operating room personnel from becoming wet during the operation, be comfortable to stand on for prolonged periods of time, and provide operating room personnel easy access to surgical tools and instruments. The present invention fulfills these needs and provides other related advantages.

SUMMARY OF THE INVENTION

The present invention resides in a portable surgical drainage platform for collecting fluids discarded during surgical operations. The surgical drainage platform generally comprises a collection basin having several distinct portions rotatably attached to one another for receiving discarded fluids, and means for preventing fluids from leaking between the distinct portions. The collection basin has an upper non-skid surface and a lower fluid impermeable reservoir, as well as means for moving the collection basin.

In the preferred embodiments of the invention, the collection basin comprises a central support tray and two outer support trays situated adjacent opposite edges of the central support tray. Each of the support trays includes a trough at an end thereof, an upper fluid receiving surface which directs fluids into the trough, a drain for evacuating fluids from the trough, and a perforated mat which overlies the fluid receiving surface and provides an upper non-skid surface. The outer support trays are attached to the central support tray by overlapping hinges. Further, a drain suction manifold is connected by tubing means to the troughs to permit single source suction of fluid from the troughs of all the support trays.

In one preferred form, the outer support trays and the central support tray are approximately coextensive in length from the front to rear of the surgical platform. An alternative form of the surgical drainage platform, however, provides a shorter central support tray in comparison with the outer support trays for purposes of positioning the portable surgical drainage platform more completely around an end of an operating room table. If desired, a removable catch basin can be placed adjacent to the shortened end of the central support tray and between the outer support trays.

Stationary roller means are fixed to the central support tray and extend downwardly for constant engagement with a ground surface. A selectively extendable and retractable roller mechanism is further situated below each outer support tray. These roller mechanisms are capable of supporting the overlying outer support tray to facilitate rolling movement of the platform. Alternatively, these roller mechanisms are capable of lowering the overlying outer support tray to place it on the ground surface for immobilizing the platform.

The outer support trays can be rotated with respect to the central support tray and folded upwardly for convenient movement and storage of the surgical drainage platform. Means are provided for locking the outer support trays in the folded position, and damping means are provided for slowing the downward movement of each outer support tray when unfolded to align the outer support trays with the central support tray.

An instrument stand can be mounted to the support trays for positioning an instrument tray over the upper surface of the collection basin. The instrument stand includes means for adjusting the vertical height of the instrument tray with respect to the collection basin, means for adjusting the horizontal angular orientation of the instrument tray with respect to the collection basin, and means for adjusting the horizontal position of the instrument tray with respect to the collection basin.

More particularly, the instrument stand includes a first vertical member rotatably extending upwardly from the collection basin, a first horizontal member fixed at one end to the first vertical member and extending perpendicularly away therefrom, a second horizontal member rotatably attached at one end to a second end of the first horizontal member, and a second vertical member rotatably attached to a second end of the second horizontal member and extending upwardly therefrom. The second vertical member includes means for selectively adjusting the height of the instrument tray. This second vertical member includes an outer vertical casing attached at its lower end to the second horizontal member, an inner vertical shaft which telescopes in and out of the upper end of the outer vertical casing, and means for fixing the relative position of the inner vertical shaft with respect to the outer vertical casing.

When the surgical drainage platform is to be used during an operation, it is typically moved into an operating room in its folded configuration and positioned adjacent an operating table. The outer support trays are rotated about their attachment to the central support tray to place them in horizontal alignment with the central support tray. The roller mechanism beneath each outer support tray can be extended to further position the surgical drainage platform as desired by the physician, and then retracted to securely place the outer support trays in direct contact with the operating room floor. The instrument stand and instrument tray are then mounted onto the collection basin and positioned for maximum convenience of the surgeon.

Other features and advantages of the present invention will become apparent from the following more detailed description, taken in conjunction with the accompanying drawings which illustrate, by way of example, the principles of the invention.

BRIEF DESCRIPTION OF THE DRAWINGS

The accompanying drawings illustrate the invention. In such drawings:

FIG. 2 is a front elevational view taken generally along the line 2—2 of FIG. 1, illustrating the manner in which the central support tray is supported by a plurality of stationary roller mechanisms, and the manner in which the outer support trays engage the operating room floor through brake pads;

FIG. 3 is a front elevational view of the surgical drainage platform similar to FIG. 2, illustrating the manner in which roller mechanisms beneath each outer support tray raise the outer trays to permit rolling movement of the platform;

FIG. 4 is an enlarged fragmented view taken generally along the line 4—4 of FIG. 3, illustrating a gas cylinder which functions as a damper for preventing the outer support trays from falling too rapidly when the platform is unfolded;

FIG. 5 is an enlarged fragmented view taken generally along the line 5—5 of FIG. 2, illustrating the manner in which a stationary roller is affixed below a fluid impermeable reservoir of the central support tray;

FIG. 6 is a front elevational view of the portable surgical drainage platform, illustrating the configuration of the outer support trays when locked in an upright position, and further illustrating the manner in which a pair of instrument stands and trays may be conveniently stored between the support trays;

FIG. 12 is a sectional view taken generally along the line 12—12 of FIG. 9;

FIG. 13 is an enlarged plan view of the hinge, taken generally along the line 13—13 of FIG. 1;

FIG. 14 is an enlarged sectional view taken generally along the line 14—14 of FIG. 1, illustrating the manner in which an instrument stand is anchored within an outer support tray;

FIG. 1 is an enlarged sectional view taken generally along the line 17—17 of FIG. 1, illustrating the construction of a second vertical member of the instrument stand;

DETAILED DESCRIPTION OF THE PREFERRED EMBODIMENT

Figure 1:
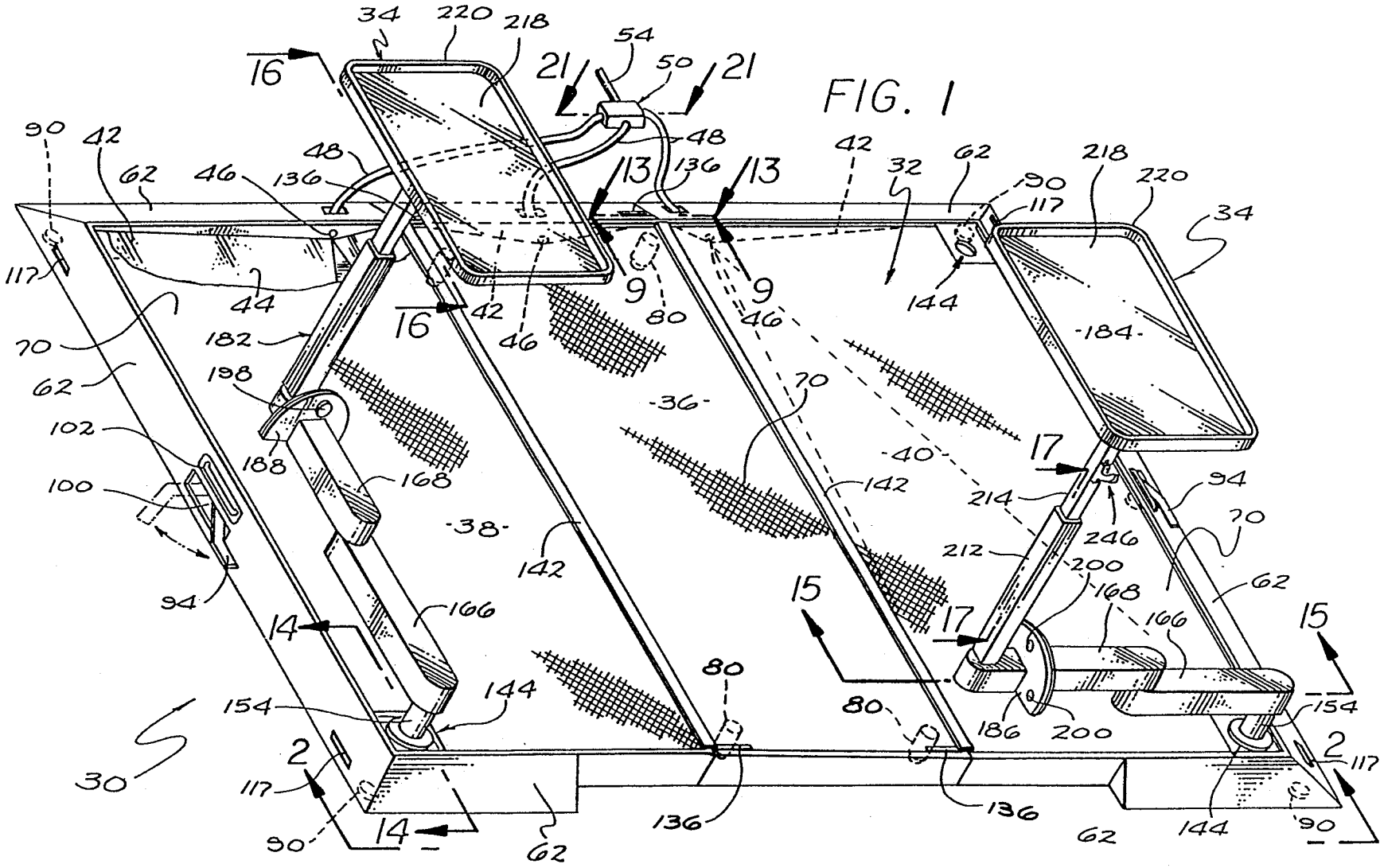
FIG. 1 is a front perspective view of a portable surgical drainage platform embodying the present invention, shown resting upon an operating room floor and being connected to suction tubing.

As shown in the drawings for purposes of illustration, the present invention is embodied in a novel surgical drainage platform, generally designated in the accompanying drawings by the reference number 30. The portable surgical drainage platform 30 is designed to collect fluids discarded during surgical operations which would otherwise be allowed to pool on an operating room floor and create a hazardous condition for operating room personnel. The drainage platform 30 is portable for movement within and between operating rooms, and provides a comfortable platform upon which a surgeon and one or more assistants may stand during an operation. In many respects the drainage platform 30 is similar to the platform shown 1 and described in U.S. Pat. No. 4,635,913, the contents of which are incorporated herein by reference.

In accordance with the invention, and as best illustrated in FIG. 1, the surgical drainage platform 30 includes a collection basin 32 and two instrument stand apparatuses 34 which are mounted upon the collection basin. The collection basin 32 includes a central support tray 36 and two outer support trays 38 and 40 which are situated adjacent opposite edges of the central support tray.

Each of the support trays 36, 38 and 40 include a trough 42 at a rearward end thereof, an upper fluid receiving surface 44 which is slightly inclined to direct fluids into the trough 42, and a drain 46 provided for evacuating fluids from the respective trough. Each drain 46 is connected to a flexible tube 48 which is attached at an opposite end to a disposable drain suction manifold 50 adaptable to ordinary wall suction. This manifold suction device 50 is provided four nipples 52 which facilitate attachment of the flexible tubes 48 thereto, and well as a primary suction tube 54 which is connected, in turn, to a suction source 56 schematically illustrated in FIG. 21.

The upper fluid receiving surfaces 44 are each formed by a floor 58 which, in connection with an integral peripheral rim 60, forms a fluid impermeable reservoir for collecting fluids discarded during the surgical operation. Extending outwardly from portions of the rim 60 is a canted edge 62 which partially forms an outer perimeter of the drainage platform 30. This canted edge 62 reduces the likelihood of operating room personnel tripping over the raised edge of the drainage platform. The forward edge of the platform is preferably vertical to permit placement of the forward edge of the platform 30 as close to an operating table as possible. Underlying the floor members 58 and generally extending peripherally around each of the support trays 36, 38 and 40, are several vertical floor support walls forming a floor support structure 64. The floor support structure 64 gives the collection basin 32 sufficient strength and rigidity to bear the weight of the surgeon and other operating room personnel.

Figure 22:
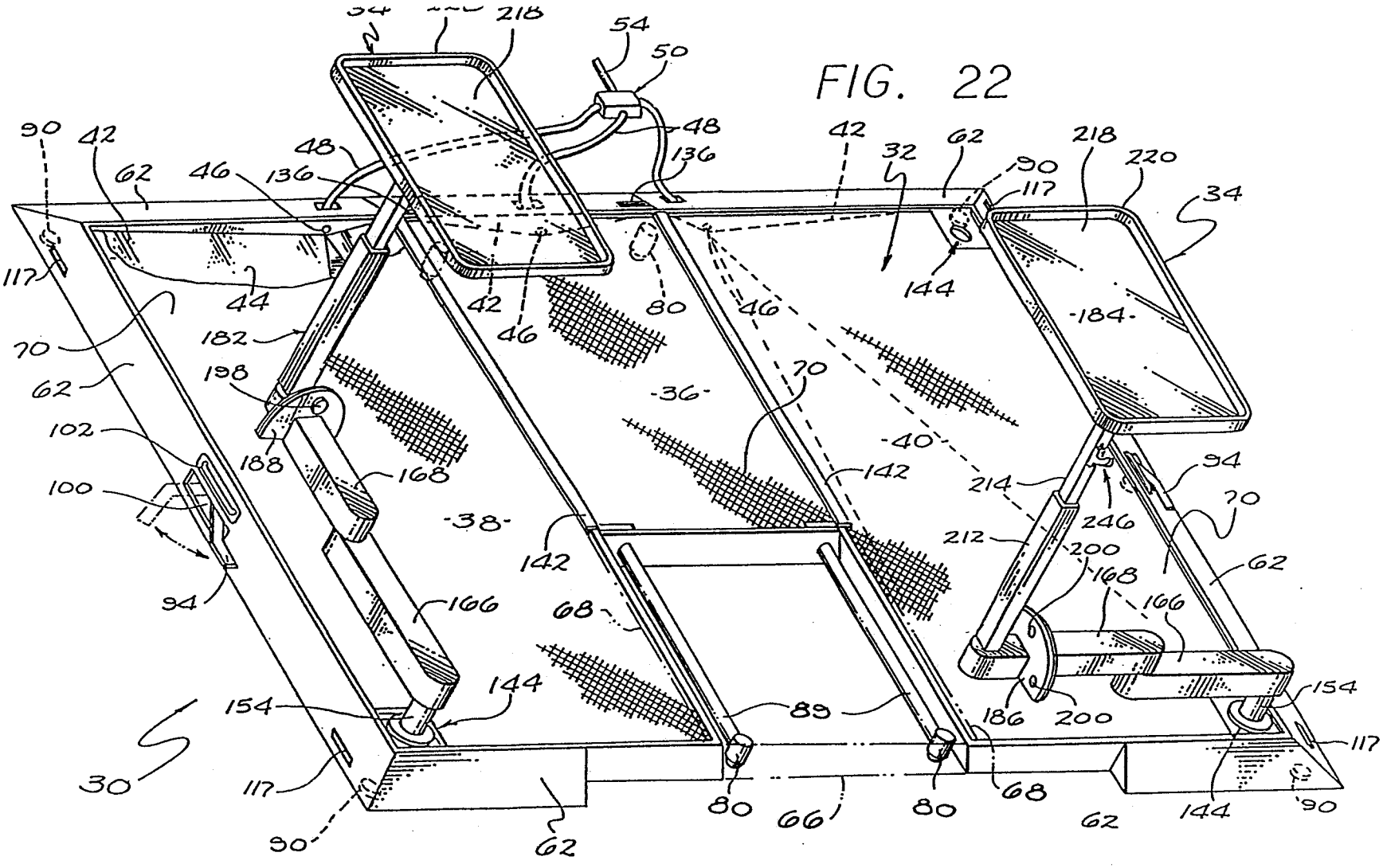
FIG. 22 is a front perspective view similar to FIG. 1, but illustrating an alternative form of the portable surgical drainage platform embodying the present invention, particularly showing a configuration having lengthened outer support trays with respect to the central support tray for extending along side an operating room table, and further illustrating a removable catch basin in phantom.

As illustrated in FIG. 22, in an alternative form the outer support trays 38 and 40 can extend forwardly beyond the forward end of the central support tray 36. This feature advantageously permits the surgical drainage platform 30 to be positioned in a manner surrounding an end of a typical operating room table. This alternative platform construction can be restructured, however, to increase the surface area (similar to the primary embodiment of FIG. 1) by positioning a removable catch basin 66 adjacent the forward end of the central support tray 36 and between the outer support trays 38 and 40 in the manner shown. It is preferred that the catch basin 66 be constructed in a manner similar to each of the support trays 36, 38 and 40, to provide a sturdy platform over which the surgeon may stand. In this regard, the catch basin 66 is provided a pair of flanges 68 which are designed to overlie portions of the outer support trays 38 and 40.

Placed within the collection basin 32 and over the upper fluid receiving surfaces 44 of the support trays 36, 38 and 40, are perforated, lightweight and elastic mats 70 which are preferably formed of a PVC material. The PVC mats 70 are perforated to allow the discarded fluids to fall through the mats into the collection basin 32. The PVC mats 70 are further elastic to provide a comfortable platform upon which a surgeon and one or more assistants stand during an operation, can be removed, are easily cleaned and may be sterilized.

More specifically, as shown in FIG. 5 the mats 70 have perforations 72 that allow the fluid falling onto the mats to pass into the collection basin 32. The undersides of the mats 70 have small stubs or protuberances 74, thus providing a clearance 76 between the mats 70 and the underlying floor 58. This clearance 76 allows the fluids falling into the collection basin 32 to flow substantially unimpeded toward the rear of the platform 30 where they are collected into the troughs 42 for subsequent evacuation and/or disposal. The mats 70 provide the collection basin 32 an upper non-skid surface.

Although the mats 70 placed on the upper fluid receiving surfaces 44 can be formed of individual square sections fitted together to cover the entire upper surface, it is preferred that a single integrated mat be provided over each support tray 36, 38, and 40. When an integral mat 70 is provided over outer support trays 38 and 40, then retaining brackets 75 are anchored by a nut 77 to the floor 58 to hold the mats in place. Preferably three such brackets 75 are provided along each outer edge of the outer support trays 38 and 40.

As shown in FIGS. 1 and 2, when the outer support trays 38 and 40 are substantially horizontally aligned with the central support tray 36, a stable platform for the surgeon and his assistants is created. The surgical drainage platform 30 is supported above a ground surface 78 by a plurality of stationary rollers 80 which are fixed to the underside of the central support tray floor 58, and which extend downwardly for constant engagement with the ground surface 78. As illustrated in FIG. 5, the stationary rollers 80 each include a roller support base 82 which engages the adjacent floor 58, a roller shaft 84, and a caster assembly 86 which positions a wheel or ball roller 88.

Similarly, the modified surgical drainage platform 30 illustrated in FIG. 22 is also supported above a ground surface 78 by a plurality of stationary rollers 80 which are fixed to the central support tray 58, and which extend downwardly for constant engagement with the ground surface 78. In contrast with FIG. 1, the platform 30 of FIG. 22 includes a pair of parallel bars 89 which extend forwardly from the shortened or forward end of the central support tray 36. These bars 89 in turn support the forward stationary rollers 80 associated with the central support tray 36.

In contrast with the stationary rollers 80 of the central support tray 36, the outer support trays 38 and 40 each have a plurality of braking pads 90 situated near their respective edges opposite the central support tray 36. These braking pads 90 are secured to a portion of the floor support structure 64 underlying the canted edge 62, to provide additional points of contact with the ground surface 78. When positioned as shown in FIG. 2, the surgical drainage platform 30 is effectively immobilized, thus providing a stable platform for the surgeon.

In order to permit the surgeon to adjust the position of the surgical drainage platform 30 when the outer support trays 38 and 40 are horizontally aligned with the central support tray 36, a selectively extendable and retractable roller mechanism 92 is situated below each outer support tray 38 and 40. These roller mechanisms 92 are actuated by a hand lever 94 which, through a linkage 96, positions pivotable rollers 98 to lift the respective outer support tray 38 or 40 upwardly a sufficient distance to disengage the braking pads 90 from the ground surface 78 (FIG. 3). As shown best in FIGS. 7 and 8, the hand lever 94 extends through a slot 100 in the canted edge of each of the outer support trays 38 and 40 (see also FIG. 1). Immediately adjacent this slot 100 is a stationary handle 102 provided for manually lifting and/or folding the outer support trays 38 and 40 with respect to the central support tray 36. The hand lever 94 is attached to a pivot shaft 104 which rotates within a pivot support 106 attached to the floor 58 of the respective outer support tray 38 or 40.

Figures 7, 8, 9, 10, 11:
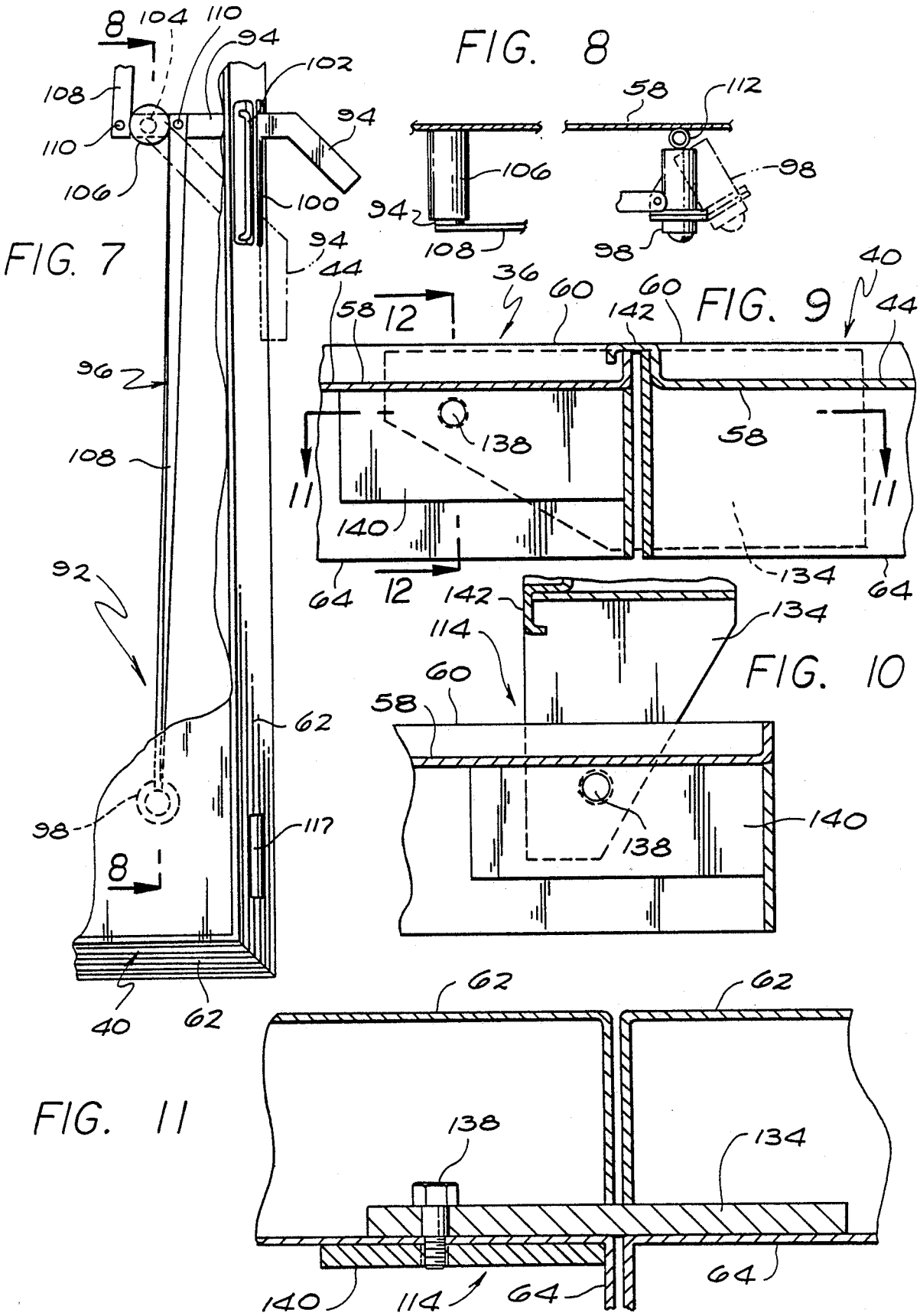
FIG. 7 is an enlarged, fragmented plan view taken generally along the line 7—7 of FIG. 3, illustrating the linkage for the roller mechanism beneath the outer support trays.
FIG. 8 is a partially sectional, fragmented view taken generally along the line 8—8 of FIG. 7.
FIG. 9 is an enlarged fragmented sectional view taken generally along the line 9—9 of FIG. 1, illustrating the manner in which the outer support tray is hinged to the central support tray.
FIG. 10 is a view similar to FIG. 9, illustrating the configuration of the hinge when the outer support tray is rotated or folded upwardly.
FIG. 11 is a sectional view taken generally along the line 11—11 of FIG. 9, further illustrating the hinge mechanism between the central and outer trays.

A pair of arms 108 are attached at pivot hinges 110 to the lever 94 on each side of the pivot support 106. These arms 108 each extend to a respective pivotable roller 98 situated generally beneath an outer corner of the respective outer support tray 38 or 40. The pivotable rollers 98 are very similar to the stationary rollers 80, with the exception that instead of being fixed to the bottom side of the floor 58, they are each provided a hinge 112 at their upper end which permits the pivotable roller 98 to be moved as illustrated in FIG. 8. Further, the arm 108 is attached to a side of the respective pivotable roller 98 to translate movement of the hand lever 94 into pivotable movement of the roller 98.

With reference now to FIG. 6, the outer support trays 38 and 40 are attached by tray hinges 114 to the central support tray 36. By rotatably attaching the outer support trays 38 and 40 to the central support tray 36, the surgical drainage platform 30 can be conveniently folded for storage or transportation between operating rooms. When folded as shown in FIG. 6, a locking arm 116 is provided to engage additional slots 117 in the canted edge 62 for holding the outer support trays 38 and 40 in their folded position 36. The instrument stand apparatuses 34 can be conveniently placed between the support trays 36, 38 and 40 as shown, and the brackets 75 hold the mats 70 in place adjacent the outer support trays. When the surgical drainage platform 30 is to be used, the locking arm 116 is simply removed from the slots 117, and the outer support trays 38 and 40 are lowered to the ground surface 78.

In this regard, it is desirable that the two outer support trays 38 and 40 be prevented from falling too rapidly when the locking arm 116 is removed. Accordingly, and as illustrated best in FIG. 4, a gas cylinder 118 is attached between the central support tray 36 and each outer support tray 38 and 40. The illustrated gas cylinder 118 comprises a tube portion 20 and a rod portion 122, and is situated generally within a channel 124 provided on the underside of the floors 58 of the outer support trays 38 and 40. The tube portion 120 is secured by a nut 126 to an anchor 128 rigidly positioned within the channel 124. The movable free end of the rod portion 122 is secured within a clevis 130 by a pivot link 132. Besides assisting in lowering the outer support trays 38 and 40, the gas cylinder 118 also helps in controllably raising these outer support trays.

The tray hinges 114 mentioned previously are illustrated in greater detail in FIGS. 9 through 13. The tray hinges 114 each comprise a reinforced hinge member 134 which is securely fixed to a portion of the floor support structure 64 of the respective outer support tray 38 or 40. This hinge member 134 extends through a hinge slot 136 provided in the central support tray 36, and is attached to the central support tray by a hinge pin 138. This hinge pin 138 extends through both the hinge member 134 and a portion of the floor support structure 64 of the central support tray 36. This portion of the floor support structure 64 is reinforced with a block 140. Also associated with the tray hinges 114 is a seam drip umbrella 142 which effectively forms an overlapping hinge between the outer support trays 38 and 40 and the central support tray 36 to prevent fluid from leaking between the adjacent support trays. The overlapping seam or drip umbrella 142 is preferably integrally formed with the rim 60 of the outer support trays 38 and 40, as shown.

Figures 15, 16, 21:
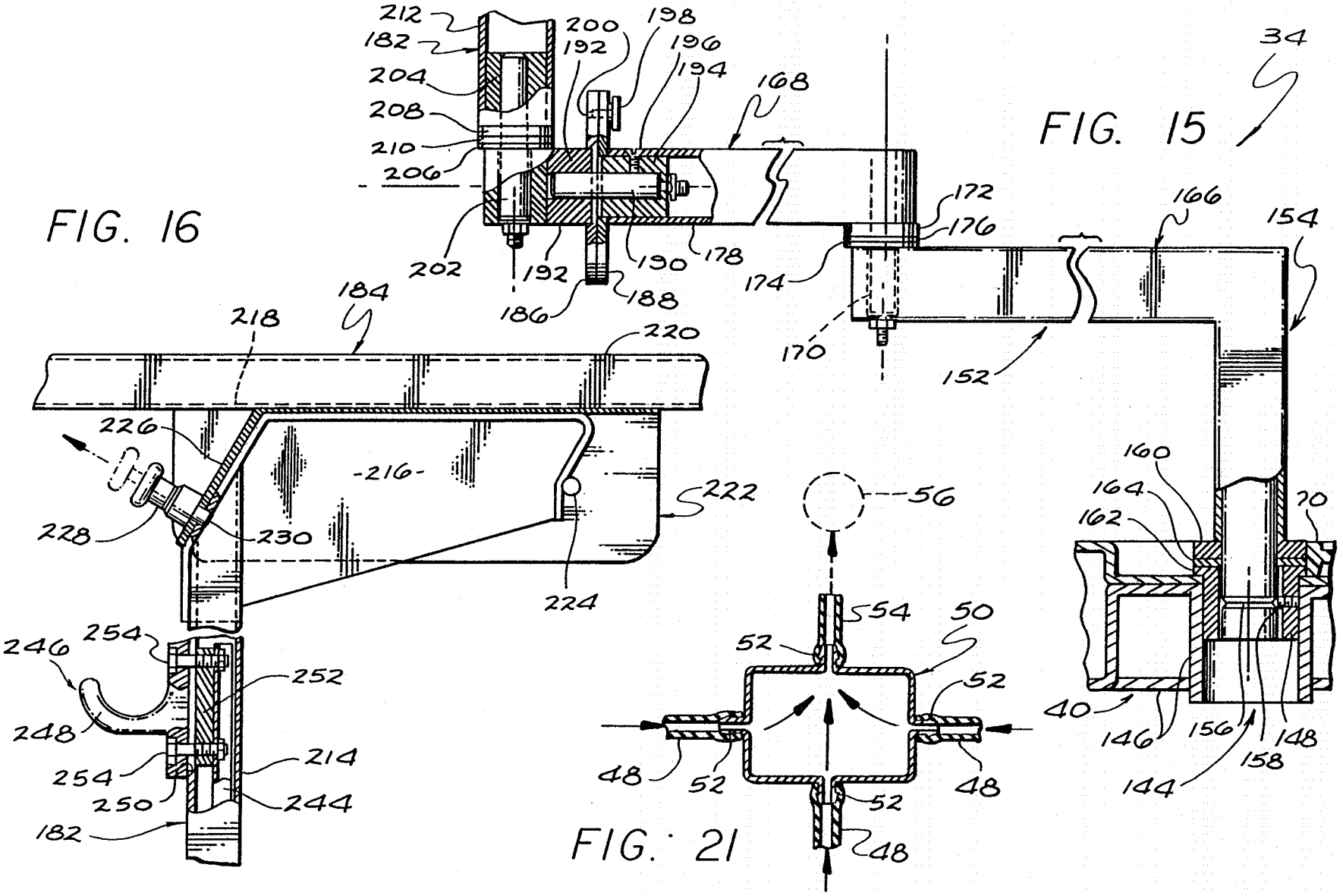
FIG. 15 is an enlarged, fragmentary and partially sectional view of the instrument stand, taken generally along the line 15—15 of FIG. 1.
FIG. 16 is an enlarged, partially sectional view of the upper end of the instrument stand and the instrument tray, taken generally along the line 16—16 of FIG. 1.
FIG. 21 is an enlarged sectional view taken generally along the line 21—21 of FIG. 1, illustrating the construction of a drain suction manifold.

As illustrated in FIGS. 1, 14 and 15, the collection basin 32, and more specifically the outer support trays 38 and 40, provide mounts 144 for the instrument stand apparatuses 34. In this regard, the floor support structure 64 underlying the outer support trays 38 and 40, includes a reinforcing structure 146 which positions a platform collar 148. This platform collar 148 provides an instrument stand receiving bore 150 in which the lower end of an instrument stand 152 is positioned.

The instrument stand 152 includes a first vertical member 154 rotatably anchored within the receiving bore 150 and extending upwardly from the collection basin 32. This first vertical member 154 includes a groove 156 which can be aligned with a set screw 158 extending through the platform collar 148 for preventing removal of the instrument stand 152 from the platform collar 148. The first vertical member 152 further includes a base flange 160 which, in connection with a collar flange 162, sandwiches a brake pad 164 therebetween. The purpose of this brake pad 164 is to prevent free or loose rotation of the instrument stand 152 about its attachment to the outer support tray 38 or 40.

The instrument stand 152 further includes a first horizontal member 166 fixed at one end to the upper end of the first vertical member 154. The first horizontal member 166 extends perpendicularly away from the first vertical member 154, and is pivotally attached by pivot shaft means 170 to a second horizontal member 168. The second horizontal member is provided a downwardly facing flange 172 which, in connection with an upwardly facing flange 174 of the first horizontal member 166, sandwiches another brake pad 176 having essentially the same function as the brake pad 164 between the base flange 160 and the collar flange 162.

The second horizontal member 168 includes two portions 178 and 180, and is in turn rotatably attached to a second vertical member 182 extending upwardly to support an instrument tray 184. The two portions 178 and 180 of the second horizontal member 168 rotatably interface with one another at an index disk 186 and a facing index pin support flange 188. The two portions and 180 share a common longitudinal axis, and are rotatably connected to one another through a horizontal pivot shaft 190. This horizontal pivot shaft is anchored within an anchor block 192 of the second portion 180, and interacts with an index block 194 within the first portion 178. A set screw 196 is provided through the first portion 178 and the index block 194 for engaging the horizontal pivot shaft 190 to prevent rotation of the second portion 180 with respect to the first portion 178. The index pin support flange 188 forming part of the first portion 178 is provided an index pin 198 designed to interact with apertures 200 provided through the index disk 186. This permits a surgeon to positively set the second portion 180 at a particular angular orientation with respect to the first portion 178, and thus influence the angular orientation of the second vertical member 182 connected to the second portion 180.

The second vertical member 182 of the instrument stand 152 includes a vertical pivot shaft 202 securely held within an anchor block 204, which shaft 202 extends downwardly through the second portion 180 of the second horizontal member 168. This permits the second vertical member 182 to rotate with respect the second horizontal member 168. The second vertical member 182 also includes a lower pivot collar 208 which, in connection with a facing upper pivot collar 206 provided on the second portion 180, sandwiches a brake pad 210 therebetween. Further, the second vertical member 182 of the instrument stand 152 includes an outer vertical casing 212 which is attached at its lower end to the second horizontal member 168, and an inner vertical shaft 214 which telescopes in and out of the upper end of the outer vertical casing.

As illustrated best in FIG. 16, attached to the upper end of the inner vertical shaft 214 is an instrument tray support structure 216. This support structure 216 is intended to interact with the instrument tray 184 and securely hold it in place. The instrument tray 184 is provided a flat tray portion 218 surrounded by a rim 220. Underlying the tray portion 218 is a U-shaped tray mount 222 having an upper horizontal portion which rests directly atop the instrument tray support structure 216, a pin 224 which engages a forward end of the support structure 216, and a rearward angular plate 226 which engages another surface of the support structure 216. Mounted upon this rearward angular plate 226 is a spring-loaded release actuator 228 having a movable pin 230 which extends downwardly and inwardly therefrom. When the instrument tray 184 is positioned upon the support structure 216, this movable pin 230 extends through an aperture provided through the support structure 216 to securely hold the instrument tray 184 in place. The instrument tray 184 can be separated from the support structure 216 by simply pulling upwardly and outwardly on the release actuator 228 to withdraw the movable pin 230 from the aperture through the support structure 216, and pivoting the instrument tray 184 generally about the pin 224. In this manner the instrument tray 184 can be conveniently removed from the instrument stand 152 for cleaning, sterilization, and/or replacement.

The inner vertical shaft 214 slides within the outer vertical casing 212 of the second vertical member 182 for selectively adjusting the height of the instrument tray 184. To accomplish this, a retention mechanism, generally designated by the reference number 232, is attached to the second vertical member 182. More particularly, and as illustrated best in FIGS. 17 through 20, the inner vertical shaft 214 is slidably mounted within the outer vertical casing 212 by means of a first bushing 234 which is fixed within the upper end of the outer vertical casing 212, and a second bushing 236 which is fixed to the lower end of the inner vertical shaft 214. A female channel member 238 extends upwardly through both the upper vertical casing 212 and the inner vertical shaft 214, and is anchored at its lower end to the outer vertical casing by means of a bracket 240 and a bolt 242. Accordingly, the female channel member 238 remains fixed or stationary within the second vertical member 182. A stop block 243 is fixed over the channel of the female channel member 238 near its lower end.

A male channel member 244 is slidably positioned within the female channel member 238 so that its lower end is substantially surrounded by the female channel member, and its upper end extends upwardly therefrom for attachment to an actuator mechanism 246. The actuator mechanism 246 includes an actuator handle 248 positioned adjacent a slot 250 provided through the upper end of the inner vertical shaft 214. The upper end of the male channel member 244 is spaced from the actuator handle 248 by a spacer block 252, and the actuator handle 248 is rigidly connected to the upper end of the male channel member 244 by means of a pair of nut and bolt combinations 254 which extend through the spacer block 252. The slot 250 permits limited vertical movement of the actuator handle 248 (and thus the male channel member 244) with respect to the inner vertical shaft 214.

The retention mechanism 232 allows the male channel member 244 to slide within and with respect to the female channel member 238 under certain circumstances, but upon the application of downward force upon the inner vertical shaft 214, causes a friction lock which prevents movement of these two channel members 238 and 244 with respect to each other. More specifically, an upper tapered block 256 is attached to a lower end of the male channel member 244. The lower end of the male channel member 244 includes a rectangular aperture 258 through which a boss 260 of the upper tapered block 256 extends. The boss 260 extends outwardly through the aperture 258 and beyond the channel of the member 238. Immediately below the upper tapered block 256 and within the female channel member 238 is a lower tapered block 262. The lower tapered block 262 and the upper tapered block 256 have inclined faces 264 which interact upon one another to wedge the tapered blocks 256 and 262 within the female channel member 238 to prevent downward movement of the male channel member 244.

The lower tapered block 262 includes a lower boss 266 which extends outwardly through the channel of the female channel member 238. A spring plate 268 is attached to the lower tapered block at the lower boss 266 by means of a screw 270. The spring plate 268 extends upwardly alongside the female channel member 238 over its channel and beyond the upper tapered block 256. The upper end of the spring plate 268 turns perpendicularly inwardly through the channel of the female channel member 238 and through an upper slot 272 of the male channel member 244. This end of the spring plate 268 is positioned within the male channel member 244 to be carried therein. The upper slot 272 permits limited movement of the male channel member 244 (and thus the upper tapered block 256) with respect to the spring plate 268 (and thus the lower tapered block 262). The spring plate 268 is provided a slot 274 through which the boss 260 of the upper tapered block 256 extends. Again, this permits limited relative movement of the upper tapered block 256 with respect to the lower tapered block 262.

Figures 17, 18, 19, 20:
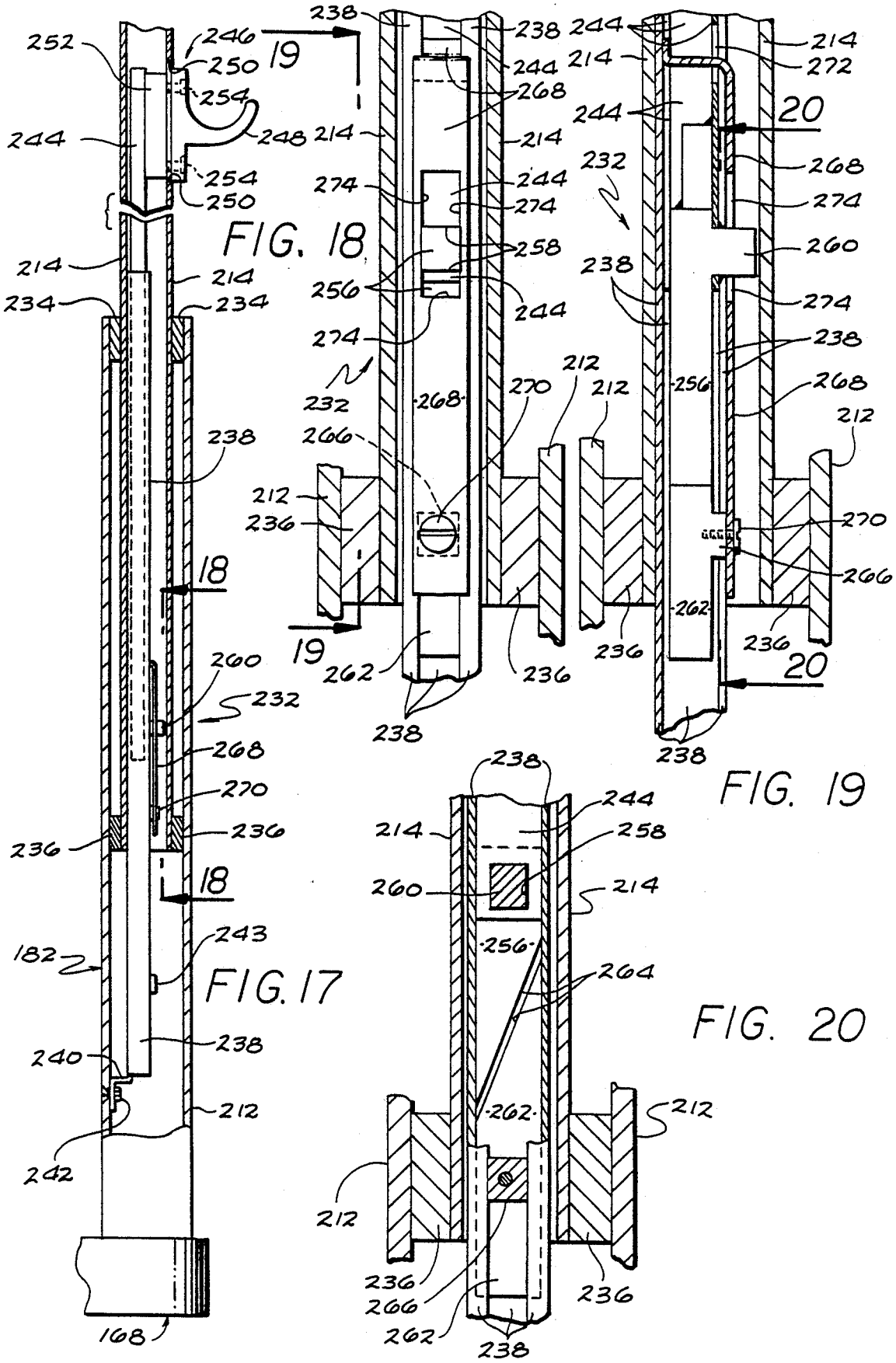
FIG. 18 is an enlarged sectional view taken generally along the line 18—18 of FIG. 17, illustrating the construction of a retention mechanism which allows the height of the instrument tray to be adjusted.
FIG. 19 is a sectional view taken generally along the line 19—19 of FIG. 18.
FIG. 20 is a further view of the retention mechanism illustrated in FIGS. 17 through 19, taken generally along the line 20—20 of FIG. 19, illustrating the configuration of the various components situated beneath a spring plate.

In operation, the actuator handle 248 is pulled upwardly to move the male channel member 244 slightly upwardly with respect to inner vertical shaft 214. Because the spring plate 268 is loosely supported within the male channel member 244, the upper tapered block 256 (which is rigidly attached to the lower end of the male channel member) is moved upwardly and spaced slightly from the lower tapered block 262 (which is supported by the spring plate 268). When the tapered blocks 256 and 262 are spaced as shown in FIG. 20, the inner vertical shaft 214 is allowed to move upwardly and downwardly within the outer vertical casing 212. To lock the inner vertical shaft 214 in a particular location with respect to the outer vertical casing 212, either the actuator handle 248 is pressed sharply downwardly to wedge the tapered blocks 256 and 262 against one another, or the top of the instrument tray 184 is simply pressed sharply downwardly to accomplish the same wedging function. In this regard, the lower tapered block 262 should be dimensioned to permit its sliding within the female channel member 238, but not be so loosely situated therein so as to prevent its engagement by the upper tapered block 256 when the male channel member 244 is thrust downwardly.

From the foregoing it is to be appreciated that the present invention provides a novel surgical drainage platform 30 for collecting fluids discarded during surgical operations. When folded, the platform can be easily stored and moved from operating room to operating room. The outer support trays 38 and 40 can be conveniently rotated downwardly from their storage position, and placed in horizontal alignment with the central support tray 36. These outer support trays 38 and 40 can be either positioned to rest firmly upon the ground surface 78, or can be raised slightly by means of roller mechanisms 92 for further movement of the surgical drainage platform 30 around the operating room. In use, the drainage platform 30 provides a comfortable surface upon which a surgeon and one or more assistants stand during an operation. The instrument stand apparatuses 34 conveniently provide means for supporting the instrument trays 184 in any convenient location for the surgeon, and further provides means for fully adjusting the positioning of the instrument trays with respect to the collection basin 32. Further, it should be apparent from the construction of the retention mechanism 232 that excessive weight placed on the instrument tray 184 will not cause a failure of the retention mechanism, nor will it change the positioning of the inner vertical shaft 214 with respect to the outer vertical casing 212. This characteristic of the instrument stand 152 arises from the fact that the weight placed on the instrument tray 184 is communicated to the actuator mechanism 246 by an abutment of the slot 250 and either the actuator handle 248 or the spacer block 252, and is thus communicated directly to the upper tapered block 256. Extra weight simply creates a tighter friction fit between the two tapered blocks 256 and 262 within the female channel member 238.

Although two particular embodiments of the invention have been described in detail for purposes of illustration, various modifications of each can be made without departing from the spirit and scope of the invention. Accordingly, the invention is not to be limited, except as by the appended claims.

I claim:

1. A portable surgical drainage platform for collecting fluids discarded during surgical operations, said platform comprising:

a collection basin for receiving discarded fluids, the collection basin having a first portion and a second portion rotatably attached to one another, the first and second portions collectively providing the collection basin and upper non-skid surface and a fluid impermeable reservoir;

means for preventing fluid from leaking between the first and second portions of the collection basin;

means for moving the collection basin, the moving means including roller means fixed to the collection basin and extending downwardly therefrom; and means for preventing unintended movement of the platform when the first and second portions of the collection basin are substantially horizontally aligned.

2. A platform as set forth in claim 1, wherein the first portion includes a central support tray and the second portion includes two outer support trays situated adjacent opposite edges of the central support tray.

3. A platform as set forth in claim 2, wherein each of the support trays includes a drain for evacuating fluids.

4. A platform as set forth in claim 1, wherein the moving means includes stationary roller means fixed to the first portion and extending downwardly for constant engagement with a ground surface.

5. A platform as set forth in claim 4, wherein the moving means includes a selectively extendable and retractable roller mechanism situated below the second portion, the roller mechanism being capable of supporting the overlying second portion to facilitate rolling movement of the platform, and being alternatively capable of lowering the second portion to place it on the ground surface to immobilize the platform.

6. A platform as set forth in claim 1, including an instrument stand mounted to the collection basin and extending over the upper surface thereof, and an instrument tray supported by the instrument stand.

7. A platform as set forth in claim 6, wherein the instrument stand includes means for adjusting the vertical height of the instrument tray with respect to the collection basin, means for adjusting the horizontal angular orientation of the instrument tray with respect to the collection basin, and means for adjusting the horizontal position of the instrument tray with respect to the collection basin.

8. A platform as set forth in claim 2, wherein the outer support trays extend beyond the central support tray, and a removable catch basin is placed adjacent an end of the central support tray and between portions of the outer support trays.

9. A portable surgical drainage platform for collecting fluids discarded during surgical operations, said platform comprising:

a collection basin for receiving discarded fluids, the collection basin providing an upper non-skid surface and an underlying fluid reservoir;

roller means fixed to the collection basin and extending outwardly from the fluid reservoir;

means for preventing the unintended movement of the collection basin when the platform is in use; and an instrument stand mounted to the collection basin and extending over the upper surface thereof, and an instrument tray mounted to the instrument stand, the instrument stand including means for adjusting the vertical height of the instrument tray with respect to the collection basin, means for adjusting the horizontal angular orientation of the instrument tray with respect to the collection basin, and means for adjusting the horizontal position of the instrument tray with respect to the collection basin.

10. A platform as set forth in claim 9, wherein the instrument stand includes a first vertical member rotatably extending upwardly from the collection basin, a first horizontal member fixed at one end to the first vertical member and extending perpendicularly away therefrom, a second horizontal member rotatably attached at one end to a second end of the first horizontal member, and a second vertical member attached to a second end of the second horizontal member and extending upwardly therefrom.

11. A platform as set forth in claim 9, wherein the collection basin includes a central support tray, an outer support tray, and means for rotatably attaching the central and outer support trays.

12. A platform as set forth in claim 11, wherein the roller means includes stationary rollers fixed to the central support tray and extending downwardly for constant engagement with a ground surface, and a roller mechanism situated below the outer support tray.

13. A platform as set forth in claim 12, wherein the preventing means includes a control apparatus for selectively extending and retracting the roller mechanism situated below the outer support tray, wherein the roller mechanism is capable of supporting the overlying outer support tray to facilitate rolling movement of the platform, and is alternatively capable of lowering the outer support tray to place it on the ground to immobilize the platform.

14. A platform as set forth in claim 11, including means for locking the outer support tray in a position substantially perpendicular to the central support tray, and means for damping the downward movement of the outer support tray when unfolded to align the outer support tray with the central support tray.

15. A portable surgical drainage platform for collecting fluids discarded during surgical operations, said platform comprising:

a collection basin for receiving discarded fluids, the collection basin providing an upper non-skid surface and a fluid impermeable reservoir;

a plurality of support trays rotatably attached to one another to form the collection basin;

means for preventing fluid from leaking between adjacent trays;

roller means for controllably moving the collection basin; and adjustable tray means mounted to the collection basin and extending upwardly therefrom, the tray means including a first vertical member rotatably extending upwardly from the collection basin, a first horizontal member attached at one end to the first vertical member and extending perpendicularly away therefrom, a second horizontal member attached at one end to a second end of the first horizontal member, a second vertical member attached to a second end of the second horizontal member and extending upwardly therefrom, and an instrument tray supported by the second vertical member.

16. A platform as set forth in claim 15, including means for locking at least one of the support trays in a folded position with respect to another substantially horizontally disposed support tray, and means for damping movement of the folded support tray when it is unfolded to align it with the other substantially horizontally disposed support tray.

17. A platform as set forth in claim 15, wherein the plurality of support trays includes a central support tray and two outer support trays situated adjacent opposite edges of the central support tray.

18. A platform as set forth in claim 17, wherein the roller means includes stationary rollers fixed to the central support tray and extending downwardly for constant engagement with a ground surface, and a roller mechanism situated below each outer support tray, and wherein the preventing means includes a control apparatus for selectively extending and retracting the roller mechanisms situated below each outer support tray, wherein the roller mechanisms are capable of supporting the overlying outer support tray to facilitate rolling movement of the platform, and are alternatively capable of lowering the outer support tray to place it on the ground surface to immobilize the platform.

19. A platform as set forth in claim 15, wherein the means for preventing fluid from leaking between adjacent trays includes an overlapping hinge.

20. A platform as set forth in claim 15, wherein the non-skid surface of the collection basin includes a removable perforated mat.

21. A platform as set forth in claim 15, wherein the second vertical member of the tray means includes means for selectively adjusting the height of the instrument tray.

22. A platform as set forth in claim 21, wherein the second vertical member of the tray means includes an outer vertical casing attached at a lower end to the second horizontal member, an inner vertical shaft which telescopes in and out of the upper end of the outer vertical casing, and means for fixing the relative position of the inner vertical shaft with respect to the outer vertical casing.

23. A portable surgical drainage platform for collecting fluids discarded during surgical operations, said platform comprising:

a central support tray for receiving discarded fluids, said central support tray having an upper non-skid surface and a lower fluid impermeable reservoir;

an outer support tray having an upper non-skid surface and means for engaging a ground surface to restrict movement of the platform;

means for rotatably attaching the central and outer support trays, the attaching means including means for preventing fluid from leaking to the ground surface between the trays; and means for moving the platform, the moving means including roller means affixed to the central support tray.

24. A platform as set forth in claim 23, including a selectively extendable and retractable roller mechanism situated below the outer support tray, the roller mechanism being capable of supporting the overlying support tray to facilitate rolling movement of the platform, and being alternatively capable of lowering the outer support tray to place it on the ground surface.

25. A platform as set forth in claim 23, including a plurality of outer support trays each having an upper non-skid surface and an underlying fluid impermeable reservoir.

26. A platform as set forth in claim 25, wherein at least one of said outer support trays is situated along an opposite edge of said central support tray with respect to another one of said outer support trays.

27. A platform as set forth in claim 25, wherein said means for preventing fluid from leaking through the ground surface between the trays includes an overlapping hinge.

28. A platform as set forth in claim 23, including an instrument stand mounted to one of the support trays and extending over the upper surface thereof, and an instrument tray mounted to the instrument stand, the instrument stand including means for adjusting the vertical height of the instrument tray with respect to the support trays, means for adjusting the horizontal angular orientation of the instrument tray with respect to the support trays, and means for adjusting the horizontal position of the instrument tray with respect to the support trays.

29. A portable surgical drainage platform for collecting fluids discarded during surgical operations, said platform comprising:

a central support tray and two outer support trays situated adjacent opposite edges of the central support tray, each of said support trays including a trough at an end thereof, an upper fluid receiving surface which directs fluids into the trough, a drain for evacuating fluids from the trough, and an upper non-skid surface overlying the fluid receiving surface;

means for rotatably attaching the outer support trays to the central support tray, said attaching means including overlapping hinges to prevent fluid from leaking between the outer support trays and the central support tray;

stationary roller means fixed to the central support tray and positioned for constant engagement with a ground surface; and a selectively extendable and retractable roller mechanism situated below each outer support tray, the roller mechanisms each being capable of supporting the overlying outer support tray to facilitate rolling movement of the platform, and being alternatively capable of lowering the outer support tray to place it on the ground surface to immobilize the platform.

30. A platform as set forth in claim 29, including an instrument stand mounted to one the trays and extending over the upper surface thereof, and an instrument tray mounted to the instrument stand, the instrument stand including means for adjusting the vertical height of the instrument tray with respect to the supporting trays, means for adjusting the horizontal angular orientation of the instrument tray with respect to the support trays, and means for adjusting the horizontal position of the instrument tray with respect to the support trays.

31. A platform as set forth in claim 30, wherein the instrument stand includes a first vertical member rotatably extending upwardly from the support tray, a first horizontal member attached at one end to the first vertical member and extending perpendicularly away therefrom, a second horizontal member rotatably attached at one end to a second end of the first horizontal member, and a second vertical member rotatably attached to a second end of the second horizontal member and extending upwardly therefrom.

32. A platform as set forth in claim 29, wherein the outer support trays extend beyond the central support tray, and a removable catch basin is placed at an end of the central support tray and between portions of the outer support trays.

33. A platform as set forth in claim 29, including a drain suction manifold connected by tubing i means to the troughs, to permit single source suction of fluid from the separate troughs simultaneously.

34. A platform as set forth in claim 29, wherein the non-skid surface of the support trays includes a removable perforated mat.

35. A platform as set forth in claim 29, including means for locking each outer support tray in a folded position when rotated about the means for rotatably attaching the outer support trays to the central support tray.

36. A device for assisting a surgeon during medical procedures, said device comprising:

a ground-engaging collection basin upon which the surgeon may stand, which collection basin can collect and retain fluids discarded during surgical operations;

an instrument stand apparatus mounted to the collection basin and extending upwardly therefrom, the instrument stand apparatus including a first vertical member extending upwardly from the collection basin, a first horizontal member attached at one end to the first vertical member and extending perpendicularly away therefrom, a second horizontal member rotatably attached at one end to a second end of the first horizontal member, a second vertical member attached to a second end of the second horizontal member and extending upwardly therefrom, and an instrument tray supported by the second vertical member; and means for adjusting the length of the second vertical member to adjust the height of the instrument tray.

37. A device as set forth in claim 36, wherein the collection basin includes a central support tray and two outer support trays situated adjacent opposite edges of the central support tray, each of said support trays including a drain for evacuating fluids from the tray, an upper fluid receiving surface which directs fluids to the drain, and an upper non-skid surface overlying the fluid receiving surface.

38. A device as set forth in claim 37, including means for preventing fluid from leaking between adjacent trays, and roller means for moving the collection basin.

39. A device as set forth in claim 36, wherein the second horizontal member includes a first portion and a second portion rotatable with respect to the first portion along the longitudinal axis of the second horizontal member, and means for limiting rotation of the second portion with respect to the first portion.

40. A device as set forth in claim 39, wherein the limiting means includes facing flange means associated with the first and second portions, respectively, and indexing means for coupling the flange means in a desired orientation.

41. A device as set forth in claim 36, wherein the second vertical member includes an outer vertical casing attached at its lower end to the second end of the second horizontal member, and an inner vertical shaft which is slidable within the outer vertical casing and extends upwardly therefrom.

42. A device as set forth in claim 41, wherein the means for adjusting the length of the second vertical member includes a female channel member positioned within and fixed to the outer vertical casing, a male channel member situated within and fixed to the inner vertical shaft, wherein the male channel member extends downwardly through the upper end of the female channel member and into the female channel member and is slidable with respect thereto, and wherein the means for adjusting the length of the second vertical member further includes a retention mechanism for holding the male channel member and the female channel member in a fixed spacial relationship, thereby fixing the position of the inner vertical shaft with respect to the outer vertical casing.

43. A device as set forth in claim 42, wherein the retention mechanism includes tapered block means which frictionally engage the female channel member to prevent downward movement of the inner vertical shaft with respect to the outer vertical casing when a downward force is applied to the male channel member.

* * * * *

UNITED STATES PATENT AND TRADEMARK OFFICE

CERTIFICATE OF CORRECTION

PATENT NO. : 4,811,937

DATED : March 14, 1989

INVENTOR(S) : Michael L. Rothman

It is certified that error appears in the above-identified patent and that said Letters Patent is hereby corrected as shown below:

In the Abstract, line 8, delete the word "basis" and insert therefor --basin--.

In column 4, line 26, delete the number "1" and insert the number --17--.

In column 4, line 68, delete the number "1" between the words "shown" and "and".

In column 5, line 21, delete the word "and" and insert therefor --as--.

In column 7, line 32, insert --generally perpendicular to the central support tray-- between the word "position" and the number "36".

In column 7, line 65, delete the word "member" and insert therefor --members--.

UNITED STATES PATENT AND TRADEMARK OFFICE

CERTIFICATE OF CORRECTION

PATENT NO. : 4,811,937

DATED : March 14, 1989

INVENTOR(S) : Michael L. Rothman

It is certified that error appears in the above-identified patent and that said Letters Patent is hereby corrected as shown below:

In column 15, line 31, insert the word --of-- between the words "one" and "the".

In column 15, line 56, delete the letter "i" between the words "tubing" and "means".

Signed and Sealed this

Tenth Day of October, 1989

*Attest:*

*Attesting Officer*

DONALD J. QUIGG

*Commissioner of Patents and Trademarks*